US009906857B2

(12) United States Patent
Sylvia et al.

(10) Patent No.: US 9,906,857 B2
(45) Date of Patent: Feb. 27, 2018

(54) UNDERWATER ACOUSTIC PROJECTOR

(71) Applicant: LOCKHEED MARTIN CORPORATION, Bethesda, MD (US)

(72) Inventors: Russell M. Sylvia, South Dartmouth, MA (US); Patrick J. Kelly, Acushnet, MA (US); Martin C. Lewis, Plymouth, MA (US)

(73) Assignee: Lockheed Martin Corporation, Bethesda, MD (US)

( * ) Notice: Subject to any disclaimer, the term of this patent is extended or adjusted under 35 U.S.C. 154(b) by 287 days.

(21) Appl. No.: 14/689,442

(22) Filed: Apr. 17, 2015

(65) Prior Publication Data

US 2015/0302843 A1 Oct. 22, 2015

Related U.S. Application Data

(60) Provisional application No. 61/980,838, filed on Apr. 17, 2014.

(51) Int. Cl.
*H04R 1/44* (2006.01)
*G10K 9/13* (2006.01)

(52) U.S. Cl.
CPC *H04R 1/44* (2013.01); *G10K 9/13* (2013.01)

(58) Field of Classification Search
CPC ..... H04R 1/44; G10K 9/13
See application file for complete search history.

(56) References Cited

U.S. PATENT DOCUMENTS 4,514,834 A 4/1985 Hanson et al.
5,206,839 A * 4/1993 Murray ..... G01V 1/145 367/171
6,230,565 B1 5/2001 Foote et al.
6,483,778 B1 * 11/2002 Pozzo ..... G10K 11/006 367/172
6,873,572 B1 3/2005 Frank
(Continued)

FOREIGN PATENT DOCUMENTS

KR 1020050023149 3/2005

OTHER PUBLICATIONS

International search report for international application No. PCT/US2015/026383, dated Jul. 13, 2015 (3 pages).
(Continued)

*Primary Examiner* — Hovhannes Baghdasaryan
(74) *Attorney, Agent, or Firm* — Hamre, Schumann, Mueller & Larson, P.C.

(57) ABSTRACT

An underwater acoustic projector for projecting acoustic energy through water is described. The acoustic projector includes a housing defining an internal cavity, a plurality of apertures in the housing that place the internal cavity in fluid communication with an external environment, an acoustic baffle disposed in the internal cavity at a first end that fluidly seals the first end of the internal cavity from the external environment, and a projector face that is disposed in the internal cavity at a second end of the internal cavity. The projector face includes a movable piston disposed between outer and inner diaphragms. A magnet is fixed within the internal cavity between the acoustic baffle and the projector face, and a moving coil is connected to the piston and arranged relative to the magnet so as to be driven by the magnet thereby driving the piston.

19 Claims, 4 Drawing Sheets

(56) References Cited

U.S. PATENT DOCUMENTS

| | | | |
|---|---|---|---|
| 7,355,926 | B2 | 4/2008 | Religa et al. |
| 2004/0221442 | A1 | 11/2004 | Osborn |
| 2009/0003643 | A1 | 1/2009 | Canivenq |
| 2012/0051188 | A1 | 3/2012 | Graber |

OTHER PUBLICATIONS

Written opinion for international application No. PCT/US2015/026383, dated Jul. 13, 2015 (7 pages).

* cited by examiner

UNDERWATER ACOUSTIC PROJECTOR

FIELD

This disclosure relates generally to an underwater acoustic projector. More specifically, this disclosure relates to an underwater acoustic projector having a moving coil apparatus.

BACKGROUND

Low frequency acoustic projectors for underwater acoustic applications can be expensive due to their generally complex designs and components. One type of low frequency acoustic projector is a moving coil type low frequency projector. Underwater acoustic moving coil type low frequency projectors are generally large, expensive, and include complex designs. The complex designs are at least partially a result of the moving coil apparatus being sensitive to pressure differentials between an internal cavity side of a projector face and an external side of the projector face that is in communication with the water. Moving coil type low frequency acoustic projectors can be de-tuned (e.g., frequency modified) if the forces acting on the projector face are not maintained in static equilibrium. To maintain static equilibrium, pressure is often supplied to the internal cavity, which can limit depth of operation and increase the size and complexity of the design, and accordingly, increase the expense as well. Known methods of supplying pressure to the internal cavity include using a self-contained underwater breathing apparatus (SCUBA) system, an air-backed system, or an oil-compensated system.

SUMMARY

An underwater acoustic projector for projecting acoustic energy through water and a method for designing the underwater acoustic projector are described. A method for maintaining a pressure differential in the underwater acoustic projector ("acoustic projector") is also described.

In one embodiment, the acoustic projector can be a low frequency acoustic projector. In such an embodiment, the acoustic projector can have a frequency below about 1,000 Hz. It is to be appreciated that this frequency range is exemplary and that the frequency of the acoustic projector can vary beyond the stated range.

The underwater acoustic projector can be a moving coil type acoustic projector that includes a moving coil apparatus.

Acoustic projectors as described herein can be standalone devices which can be submerged underwater without being coupled to an underwater vehicle, an underwater vessel, or the like. Alternatively, the acoustic projector can be coupled to an underwater vehicle, underwater vessel, or the like.

The acoustic projector can be designed to be expendable. Accordingly, the acoustic projector can have a lifetime (once submerged underwater) that is based on a lifetime of an expendable device with which it is used (e.g., a sonobuoy, or the like).

The acoustic projector can receive water in an internal cavity of its housing to maintain the pressure differential between the internal cavity and a projector face of the acoustic projector in static equilibrium. This may increase a range of water depths for which the acoustic projector can be used.

An underwater acoustic projector for projecting acoustic energy through water is described. In one embodiment, the underwater acoustic projector includes a housing including a first plurality of apertures so that an internal cavity of the housing is in fluid communication with an external environment. The internal cavity includes an acoustic baffle disposed at a first end of the internal cavity that fluidly seals a first portion of the internal cavity from a second portion of the internal cavity. The underwater acoustic projector further includes a moving coil and a fixed magnet that are disposed in the second portion of the internal cavity. A projector face is disposed at a second end of the internal cavity, the projector face including a piston disposed in a space between an outer diaphragm and an inner diaphragm, and the piston is connected to the moving coil.

A method of designing an underwater acoustic projector is described. In one embodiment, the method includes designing a housing including a first plurality of apertures so that an internal cavity of the housing is in fluid communication with an external environment. The internal cavity includes an acoustic baffle disposed at a first end of the internal cavity that fluidly seals a first portion of the internal cavity from a second portion of the internal cavity.

The underwater acoustic projector further includes a moving coil and a fixed magnet that are disposed in the second portion of the internal cavity. A projector face is disposed at a second end of the internal cavity, the projector face including a piston disposed in a space between an outer diaphragm and an inner diaphragm, and the piston is connected to the moving coil.

A method of compensating for pressure differences in an underwater acoustic projector is also described. In one embodiment, the method includes submerging the acoustic projector in water such that water flows into an internal cavity of the acoustic projector and contacts a surface of an inner diaphragm of a projector face and the water is in contact with a surface of an outer diaphragm of the projector face.

BRIEF DESCRIPTION OF THE DRAWINGS

References are made to the accompanying drawings that form a part of this disclosure and which illustrate embodiments in which the systems and methods described in this specification can be practiced.

Like reference numbers represent like parts throughout.

DETAILED DESCRIPTION

Figure 1:
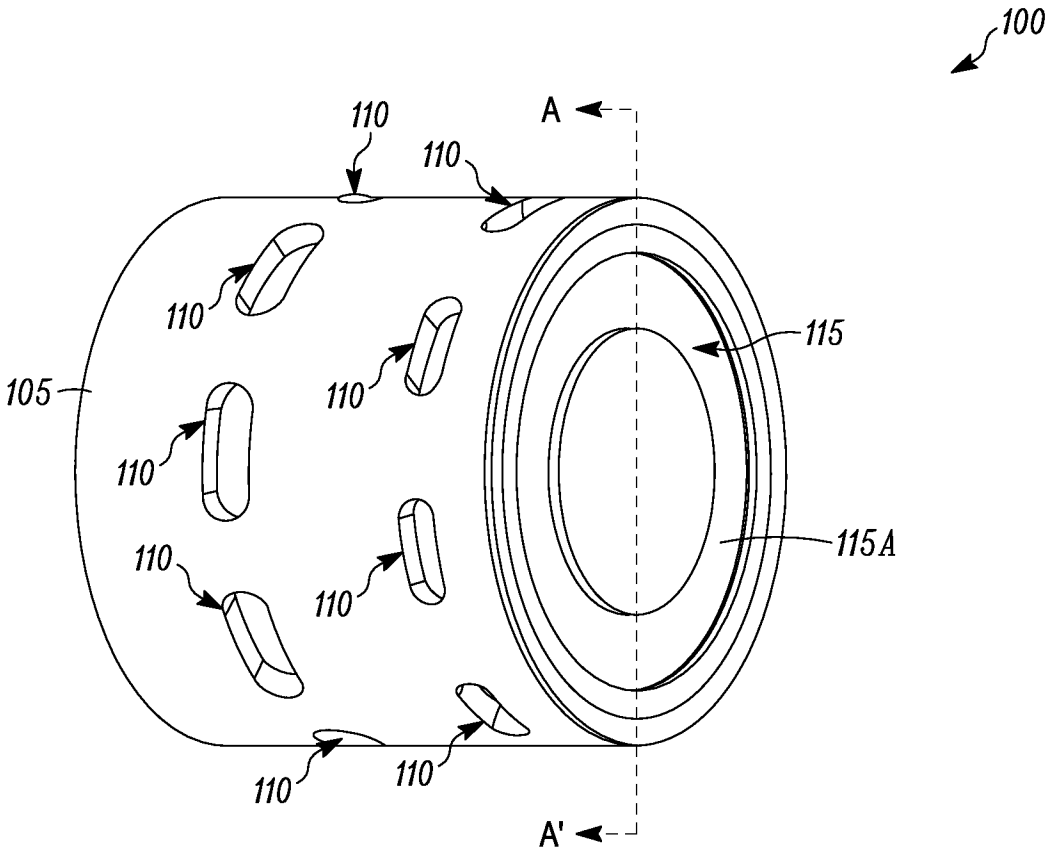
FIG. 1 illustrates an underwater acoustic projector.

FIG. 1 illustrates an underwater acoustic projector 100 (hereinafter the acoustic projector 100). The acoustic projector 100 can be submerged in any body of water, including but not limited to saltwater, freshwater, brackish water, and the like. Submerging the acoustic projector 100 includes submerging a portion of the acoustic projector 100 as well as submerging the entire acoustic projector 100.

The acoustic projector 100 includes a cylindrical housing 105. The housing 105 includes a plurality of apertures 110. The apertures 110 are spaced circumferentially from one another about a circumference of the housing 105. The apertures 110 are designed to permit introduction of water into an internal cavity (internal cavity 200 illustrated in FIG. 2) of the housing 105. Permitting water into the internal cavity 200 equalizes the pressure between the internal cavity 200 and the water outside of the housing 105. The housing 105 also includes an outer diaphragm 115 disposed at one end of the housing 105. The outer diaphragm 115 includes an outer surface 115A that is in contact with water when the acoustic projector 100 is submerged. The outer diaphragm is a part of a projector face (projector face 215 illustrated in FIG. 2) of the acoustic projector 100.

Figure 2:
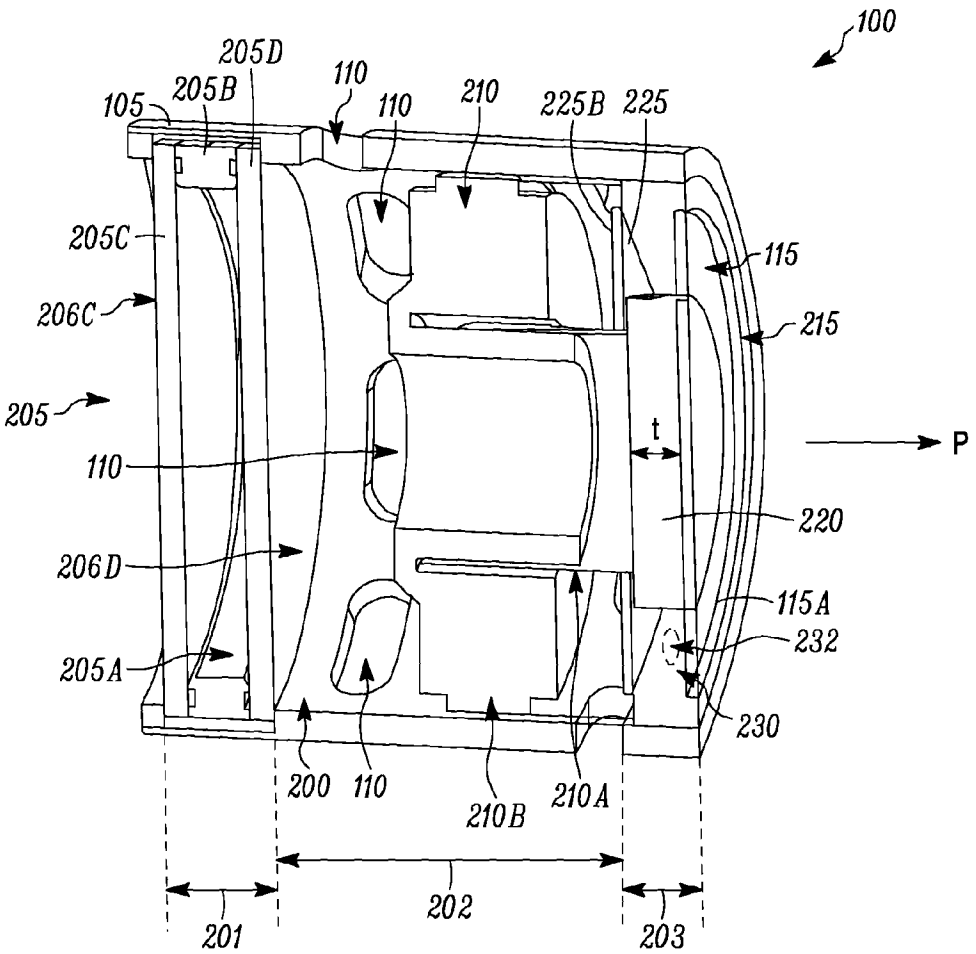
FIG. 2 illustrates a sectional view of the underwater acoustic projector of FIG. 1.

FIG. 2 illustrates a sectional perspective view of the acoustic projector 100 of FIG. 1 along a plane that extends along a longitudinal axis of the acoustic projector 100 from the line A-A'.

The internal cavity 200 of the housing 105 includes an acoustic baffle 205, a moving coil apparatus 210, and a projector face 215. As illustrated, the internal cavity 200 is divided into three portions 201-203 by these features. The moving coil apparatus 210 is disposed between the acoustic baffle 205 and the projector face 215 in portion 202 of the housing 105. The portion 202 of the housing 105 includes the plurality of apertures 110. Accordingly, the portion 202 of the housing 105 can be flooded with water when the acoustic projector 100 is submerged.

The acoustic baffle 205 is disposed in portion 201 of the housing 105. The illustrated acoustic baffle 205 includes an air cavity 205A radially sealed by a gasket 205B disposed between an outer diaphragm 205C and an inner diaphragm 205D. The air cavity 205A is substantially liquid tight to prevent ingress of water into the air cavity 205A. When submerged underwater, surface 206C of the outer diaphragm 205C and surface 206D of the inner diaphragm 205D are both in contact with water. The design of the acoustic baffle 205 is application-specific and can be selected to accommodate particular depth and pressure requirements for the acoustic projector 100. The acoustic baffle 205 can absorb acoustic energy in order to direct the acoustic energy produced by the acoustic projector 100 in the desired direction and can, for example, be an acoustic sound absorbing rubber. The desired direction is illustrated by the arrow P, which is projecting outward from the projector face 215.

The projector face 215 includes an inner diaphragm 225 and the outer diaphragm 115, with a piston 220 disposed between the inner and outer diaphragms 225, 115. A space 230 is created between the inner and outer diaphragms 225, 115 that corresponds to the thickness t of the piston 220. The space 230 can be filled with a liquid in order to maintain the space 230 when the acoustic projector 100 is submerged in water. Examples of the liquid include, but are not limited to, oil, water, or the like. The liquid can be added to the space 230 through one or more apertures 232. The one or more apertures 232 can be sealed by, for example, a setscrew, when oil is used. In such embodiments, the one or more apertures 232 can include an aperture for adding oil and an aperture for air to escape the space 230 when the space 230 is filled with the oil. When the liquid is water, the one or more apertures 232 can allow water into the space 230 as the acoustic projector 100 is submerged. In such a case, the one or more apertures 232 can be designed (e.g., size, number of apertures, or the like) to control the inflow of water. A surface 225B of the inner diaphragm 225 is in communication with portion 202 of the housing 105. A surface 115A of the outer diaphragm 115 is in communication with the water when submerged. In order for the acoustic projector 100 to function properly (e.g., prevent alteration of the frequency), the pressure on the surface 115A and the pressure on the surface 225B are maintained in static equilibrium by flooding the portion 202 of the housing 105 with water.

Disposed between the acoustic baffle 205 and the projector face 215 is the moving coil apparatus 210. The moving coil apparatus 210 operates according to principles known in the art and includes a moving coil 210A and a fixed magnet 210B. The moving coil 210A is connected to the piston 220. Pulses of electricity can be sent through the moving coil 210A, which rapidly reverses the polarity of its magnetic field. As a result, the moving coil 210A alternates between being attracted to the fixed magnet 210B and being repelled by the fixed magnet 210B. The vibration of the moving coil 210A causes the piston 220 to vibrate back and forth, generating acoustic energy.

Figure 3:
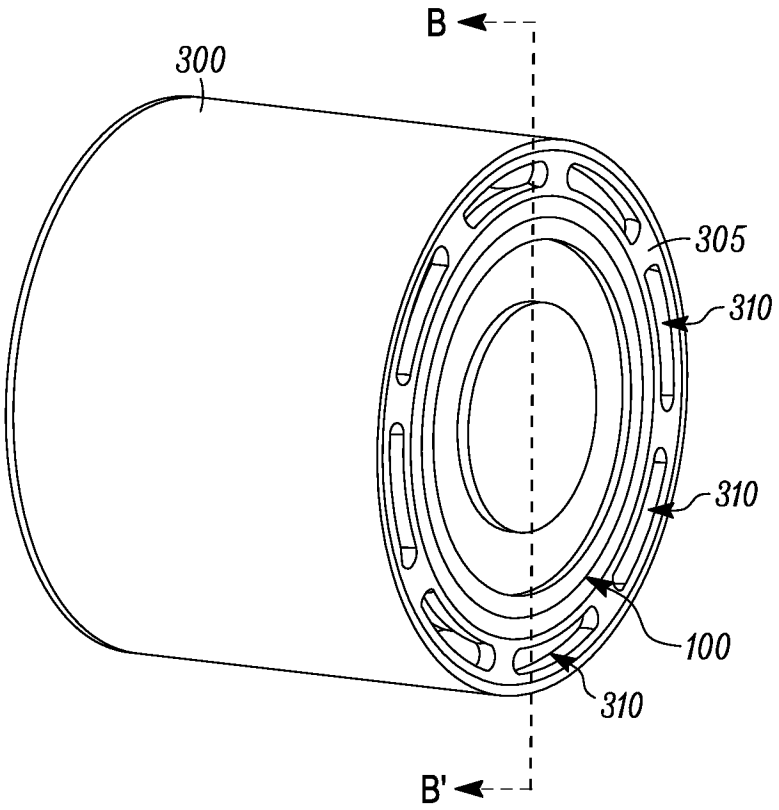
FIG. 3 illustrates the underwater acoustic projector of FIG. 1 installed in a pressure hull.
Figure 4:
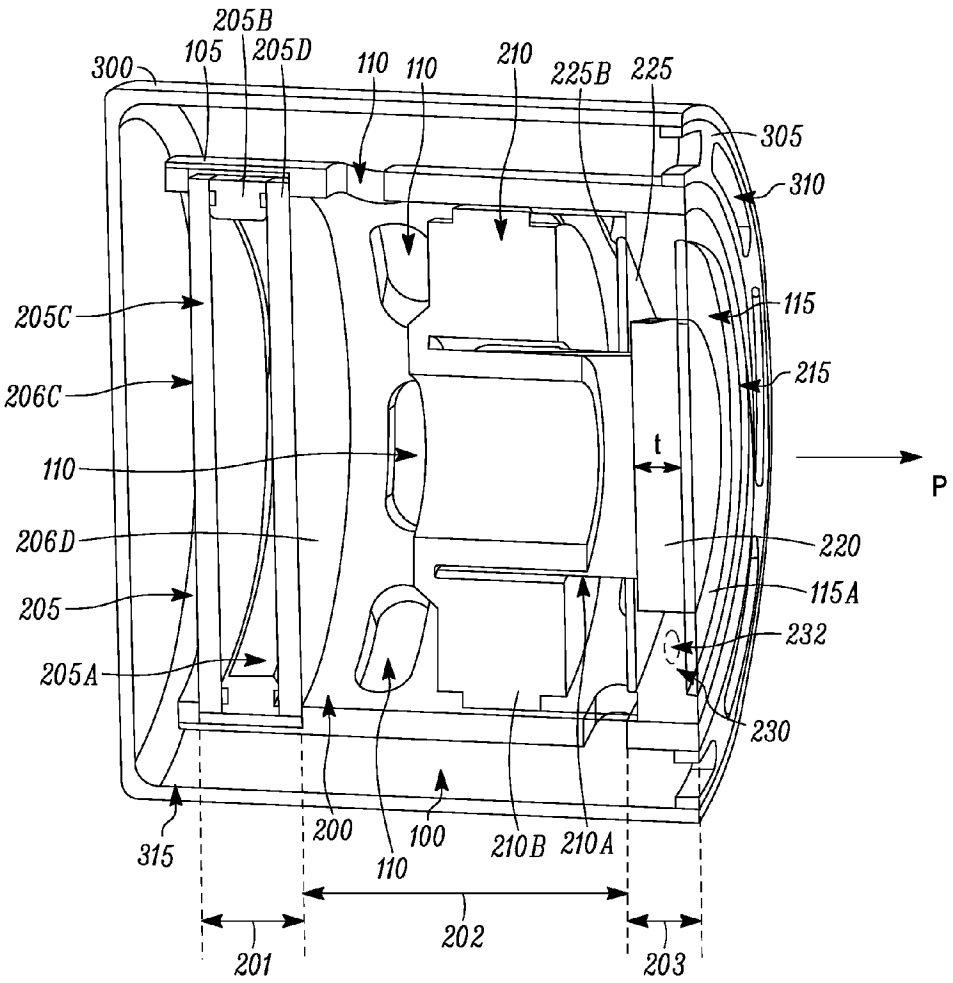
FIG. 4 illustrates a sectional view of the underwater acoustic projector of FIG. 1 installed in the pressure hull of FIG. 3.

FIG. 3 illustrates the acoustic projector 100 of FIG. 1 in a pressure hull 300, for example of an underwater vehicle such as an unmanned underwater vehicle. The pressure hull 300 can be part of any underwater body that is fluidly sealed to prevent entry of water such as, but not limited to, an underwater vehicle, an underwater vessel, or the like. FIG. 4 illustrates a sectional view of the acoustic projector 100 installed in the pressure hull 300 of FIG. 3 along a plane that extends along a longitudinal axis of the acoustic projector 100 from the line B-B'.

The pressure hull 300 is sealed to prevent entry of water into the vehicle of which it is part. The pressure hull 300 has a larger diameter than the housing 105 such that the acoustic projector 100 can be inserted into the pressure hull 300. The pressure hull 300 includes a cavity face 305 disposed at an end of the acoustic projector 100 including the projector face 115. The cavity face 305 is securely connected to an internal wall of the pressure hull 300 and the housing 105 of the acoustic projector 100. The cavity face 305 includes a plurality of apertures 310 for permitting introduction of water into an internal cavity 315 of the pressure hull 300. Water entering the plurality of apertures 310 can also enter the plurality of apertures 110 on the housing 105 of the acoustic projector 100. Accordingly, the acoustic projector 100 can rely on pressurization with the water as described above even when installed in the pressure hull 300. The materials used for the pressure hull 300 can be application specific and may, for example, be selected based on depth and pressure requirements of the application.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. An underwater acoustic projector for projecting acoustic energy through water, comprising:

a housing defining an internal cavity and the housing having a first end and a second end;

a plurality of first apertures through the housing in a portion of the housing that extends from the first end to the second end of the housing, the first apertures being disposed between the first end and the second end of the housing, the first apertures placing the internal cavity in fluid communication with an external environment;

an acoustic baffle disposed in the internal cavity at the first end thereof that fluidly seals the first end of the internal cavity from the external environment;

a projector face disposed in the internal cavity at the second end thereof, the projector face including a movable piston disposed in a space between an outer diaphragm and an inner diaphragm;

a magnet fixed within the internal cavity between the acoustic baffle and the projector face; and a moving coil connected to the piston, the moving coil is arranged relative to the magnet so as to be driven by the magnet and thereby drive the piston.

2. The underwater acoustic projector according to claim 1, further comprising:

a liquid provided in the space between the inner diaphragm and the outer diaphragm.

3. The underwater acoustic projector according to claim 2, wherein the liquid is one of water or oil.

4. The underwater acoustic projector according to claim 1, further comprising:

one or more second apertures formed in the housing that can place the space between the inner diaphragm and the outer diaphragm in communication with the external environment.

5. The underwater acoustic projector according to claim 4, further comprising one or more seals for sealing the one or more second apertures.

6. The underwater acoustic projector according to claim 1, wherein the acoustic baffle includes an acoustic sound absorbing rubber.

7. The underwater acoustic projector according to claim 1, wherein the first apertures are formed in the housing between the magnet and the acoustic baffle.

8. The underwater acoustic projector according to claim 1, wherein the inner diaphragm includes an interior surface that faces toward the acoustic baffle and water that enters the housing through the first apertures is in contact with the interior surface and in contact with the acoustic baffle.

9. A method, comprising:

designing the underwater acoustic projector according to claim 1 to permit water to flood the internal cavity of the housing of the underwater acoustic projector when the underwater acoustic projector is submerged in water so that the water equalizes pressure between the internal cavity of the housing and exterior pressure acting on the projector face of the underwater acoustic projector.

10. The method according to claim 9, further comprising:

designing the underwater acoustic projector to be fixable in a pressure hull, wherein the pressure hull includes part of any underwater body that is fluidly sealed to prevent entry of water.

11. The underwater acoustic projector according to claim 1, wherein the housing is cylindrical and has a circumference, the first apertures being spaced from one another about the circumference of the housing.

12. A method, comprising:

submerging an underwater acoustic projector in water, the underwater acoustic projector including:

a housing defining an internal cavity and the housing having a first end and a second end;

a plurality of first apertures through the housing in a portion of the housing that extends from the first end to the second end of the housing, the first apertures being disposed between the first end and the second end of the housing, the first apertures placing the internal cavity in fluid communication with an external environment;

an acoustic baffle disposed in the internal cavity at the first end thereof that fluidly seals the first end of the internal cavity from the external environment;

a projector face disposed in the internal cavity at the second end thereof, the projector face including a movable piston disposed in a space between an outer diaphragm and an inner diaphragm; a magnet fixed within the internal cavity between the acoustic baffle and the projector face; and a moving coil connected to the piston, the moving coil is arranged relative to the magnet so as to be driven by the magnet and thereby drive the piston, whereby water floods the internal cavity of the housing of the underwater acoustic projector so that the water equalizes pressure between the internal cavity of the housing and exterior pressure acting on the projector face of the underwater acoustic projector.

13. The method according to claim 12, wherein the underwater acoustic projector is disposed within a pressure hull.

14. The method according to claim 12, comprising permitting water to flood the space between the inner diaphragm and the outer diaphragm of the underwater acoustic projector.

15. An underwater acoustic projector for projecting acoustic energy through water, comprising:

a housing defining an internal cavity having a first end and a second end;

a plurality of first apertures in the housing that place the internal cavity in fluid communication with an external environment;

an acoustic baffle disposed in the internal cavity at the first end thereof that fluidly seals the first end of the internal cavity from the external environment;

a projector face disposed in the internal cavity at the second end thereof, the projector face including a movable piston disposed in a space between an outer diaphragm and an inner diaphragm;

a magnet fixed within the internal cavity between the acoustic baffle and the projector face;

a moving coil connected to the piston, the moving coil is arranged relative to the magnet so as to be driven by the magnet and thereby drive the piston; and one or more second apertures formed in the housing that can place the space between the inner diaphragm and the outer diaphragm in communication with the external environment.

16. The underwater acoustic projector according to claim 15, further comprising one or more seals for sealing the one or more second apertures.

17. An underwater acoustic projector for projecting acoustic energy through water, comprising:

a housing defining an internal cavity having a first end and a second end;

a plurality of first apertures in the housing that place the internal cavity in fluid communication with an external environment;

an acoustic baffle disposed in the internal cavity at the first end thereof that fluidly seals the first end of the internal cavity from the external environment, wherein the acoustic baffle includes an acoustic sound absorbing rubber;

a projector face disposed in the internal cavity at the second end thereof, the projector face including a movable piston disposed in a space between an outer diaphragm and an inner diaphragm;

a magnet fixed within the internal cavity between the acoustic baffle and the projector face; and a moving coil connected to the piston, the moving coil is arranged relative to the magnet so as to be driven by the magnet and thereby drive the piston.

18. An underwater acoustic projector for projecting acoustic energy through water, comprising:

a housing defining an internal cavity having a first end and a second end;

a plurality of first apertures in the housing that place the internal cavity in fluid communication with an external environment;

an acoustic baffle disposed in the internal cavity at the first end thereof that fluidly seals the first end of the internal cavity from the external environment;

a projector face disposed in the internal cavity at the second end thereof, the projector face including a movable piston disposed in a space between an outer diaphragm and an inner diaphragm;

a magnet fixed within the internal cavity between the acoustic baffle and the projector face; and a moving coil connected to the piston, the moving coil is arranged relative to the magnet so as to be driven by the magnet and thereby drive the piston, wherein the first apertures are formed in the housing between the magnet and the acoustic baffle.

19. An underwater acoustic projector for projecting acoustic energy through water, comprising:

a housing defining an internal cavity having a first end and a second end;

a plurality of first apertures in the housing that place the internal cavity in fluid communication with an external environment;

an acoustic baffle disposed in the internal cavity at the first end thereof that fluidly seals the first end of the internal cavity from the external environment;

a projector face disposed in the internal cavity at the second end thereof, the projector face including a movable piston disposed in a space between an outer diaphragm and an inner diaphragm;

a magnet fixed within the internal cavity between the acoustic baffle and the projector face; and a moving coil connected to the piston, the moving coil is arranged relative to the magnet so as to be driven by the magnet and thereby drive the piston, wherein the inner diaphragm includes an interior surface that faces toward the acoustic baffle and water that enters the housing through the first apertures is in contact with the interior surface and in contact with the acoustic baffle.

* * * * *